US009829849B2

(12) United States Patent
Maruta

(10) Patent No.: US 9,829,849 B2
(45) Date of Patent: Nov. 28, 2017

(54) IMAGE FORMING APPARATUS

(71) Applicant: KYOCERA Document Solutions Inc., Osaka (JP)

(72) Inventor: Masaaki Maruta, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/280,151

(22) Filed: Sep. 29, 2016

(65) Prior Publication Data

US 2017/0102660 A1 Apr. 13, 2017

(30) Foreign Application Priority Data

Oct. 9, 2015 (JP) ..... 2015-201177

(51) Int. Cl.

| | |
|---|---|
| ***B65H 31/04*** | (2006.01) |
| ***G03G 15/00*** | (2006.01) |
| ***B65H 31/22*** | (2006.01) |
| ***B65H 31/02*** | (2006.01) |
| *B65H 31/12* | (2006.01) |
| *B65H 31/18* | (2006.01) |
| *B65H 31/14* | (2006.01) |

(52) U.S. Cl.

CPC ..... *G03G 15/6529* (2013.01); *B65H 31/02* (2013.01); *B65H 31/22* (2013.01); *G03G 15/6552* (2013.01); *B65H 31/12* (2013.01); *B65H 31/14* (2013.01); *B65H 31/18* (2013.01); *B65H 2301/4212* (2013.01); *B65H 2405/11151* (2013.01); *B65H 2405/11161* (2013.01); *B65H 2405/11162* (2013.01); *B65H 2801/12* (2013.01)

(58) Field of Classification Search

CPC ..... B65H 31/12; B65H 31/14; B65H 31/18; B65H 2405/11161; B65H 2405/11162

See application file for complete search history.

(56) References Cited

U.S. PATENT DOCUMENTS 5,984,299 A * 11/1999 Hirota ..... B65H 31/14 271/161

2014/0321877 A1* 10/2014 Ono ..... G03G 15/6552 399/92

FOREIGN PATENT DOCUMENTS

JP 09-194108 A 7/1997

* cited by examiner

*Primary Examiner* — Howard Sanders

(74) *Attorney, Agent, or Firm* — Studebaker & Brackett PC

(57) ABSTRACT

An image forming apparatus includes an ejecting port, an ejected sheet tray and a guiding member. The ejected sheet tray has a sheet stacking face inclined upwardly towards a downstream side from a lower side of the ejecting port. The guiding member is provided at a position on the sheet stacking face to contact with a tip end of the ejected sheet at the position. The guiding member includes a base member attached to the sheet stacking face, a movable guide for stacking the ejected sheet and a biasing member. The movable guide is turnably supported on the base member around a supporting shaft. The biasing member is interposed between the base member and the movable guide at an upstream side from the supporting shaft to bias the movable guide upwardly. The movable guide is turned downwardly against a biasing force of the biasing member by weight of stacked sheets.

8 Claims, 7 Drawing Sheets

IMAGE FORMING APPARATUS

INCORPORATION BY REFERENCE

This application is based on and claims the benefit of priority from Japanese Patent application No. 2015-201177 filed on Oct. 9, 2015, the entire contents of which are incorporated herein by reference.

BACKGROUND

The present disclosure relates to an image forming apparatus including an ejected sheet tray onto which a sheet having a formed image is ejected.

In an image forming apparatus, such as a printer or a multifunction peripheral, a sheet on which an image has been formed is ejected from an ejecting port to an ejected sheet tray. The ejected sheet tray is provided so as to incline upwardly from a lower side than the ejecting port towards a downstream side in an ejecting direction. Because the ejected sheet tray is thus inclined, a stack amount of sheets ejected to the ejected sheet tray may be increased. However, if the ejected sheet tray is thus inclined, a difference in height between the ejecting port and the ejected sheet tray becomes large.

Incidentally, there are many types of sheets on which an image is formed and an environment in which the sheets are stored as well is different depending on a user. Depending on the type or the maintenance environment of sheet, when a sheet having a formed image is ejected from the ejecting port, there may be a case in which a tip end of the sheet is prone to warp (to curl) downwardly. As mentioned above, if the difference in height between the ejecting port and the ejected sheet tray is large, the tip end of the sheet is warped downwardly, the front face and the back face of the sheet is inverted or the ejected position is shifted, and then, there may be an apprehension that a sheet stock failure occurs.

In order to improve such a stock failure, there may be a case in which a guiding member is set on the ejected sheet tray. Because the guiding member is set on the ejected sheet tray, a difference in height between the ejecting port and the guiding member becomes smaller than the difference in height between the ejecting port and the ejected sheet tray and the tip end of the ejected sheet comes into contact with the guiding member before the tip end is warped, and therefore, a sheet being prone to curl is appropriately ejected. For example, there is known a placement tray of an image forming apparatus including a guiding member which is formed by assembling a sheet-shaped material.

However, there is a problem that, if the guiding member is set on the ejected sheet tray as mentioned above, the height of sheets which can be stacked becomes small by the height of the guiding member and the sheet stack amount of the ejected sheet tray is decreased. For example, depending on dimensions or shape of the guiding member, in a case where the guiding member has been attached, with respect to 500 of the maximum number of stackable sheets, in a cardboard of which tip end is prone to curl up, there may be an apprehension that the number of stackable sheets of a cardboard of which tip end is prone to warp is decreased to 300 to 350.

SUMMARY

In accordance with an embodiment of the present disclosure, an image forming apparatus includes an ejecting port, an ejected sheet tray and a guiding member. From the ejecting port, a sheet is ejected. The ejected sheet tray has a sheet stacking face inclined upwardly towards a downstream side in an ejecting direction of the sheet from a lower side of the ejecting port. The guiding member is provided at a position on the sheet stacking face and comes into contact with a tip end of the ejected sheet at the position. The guiding member includes a base member, a movable guide and a biasing member. The base member is detachably attached to the sheet stacking face. On the movable guide, the ejected sheet is stacked. The movable guide is turnably supported on the base member around a supporting shaft extending in a width direction of the sheet orthogonal to the ejecting direction. The biasing member is interposed between the base member and the movable guide at an upstream side in the ejecting direction more than the supporting shaft to bias the movable guide upwardly. The movable guide is turned downwardly against a biasing force of the biasing member by weight of stacked sheets.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, an image forming apparatus according to an embodiment of the present disclosure will be described with reference to the accompanying drawings.

Figure 1:
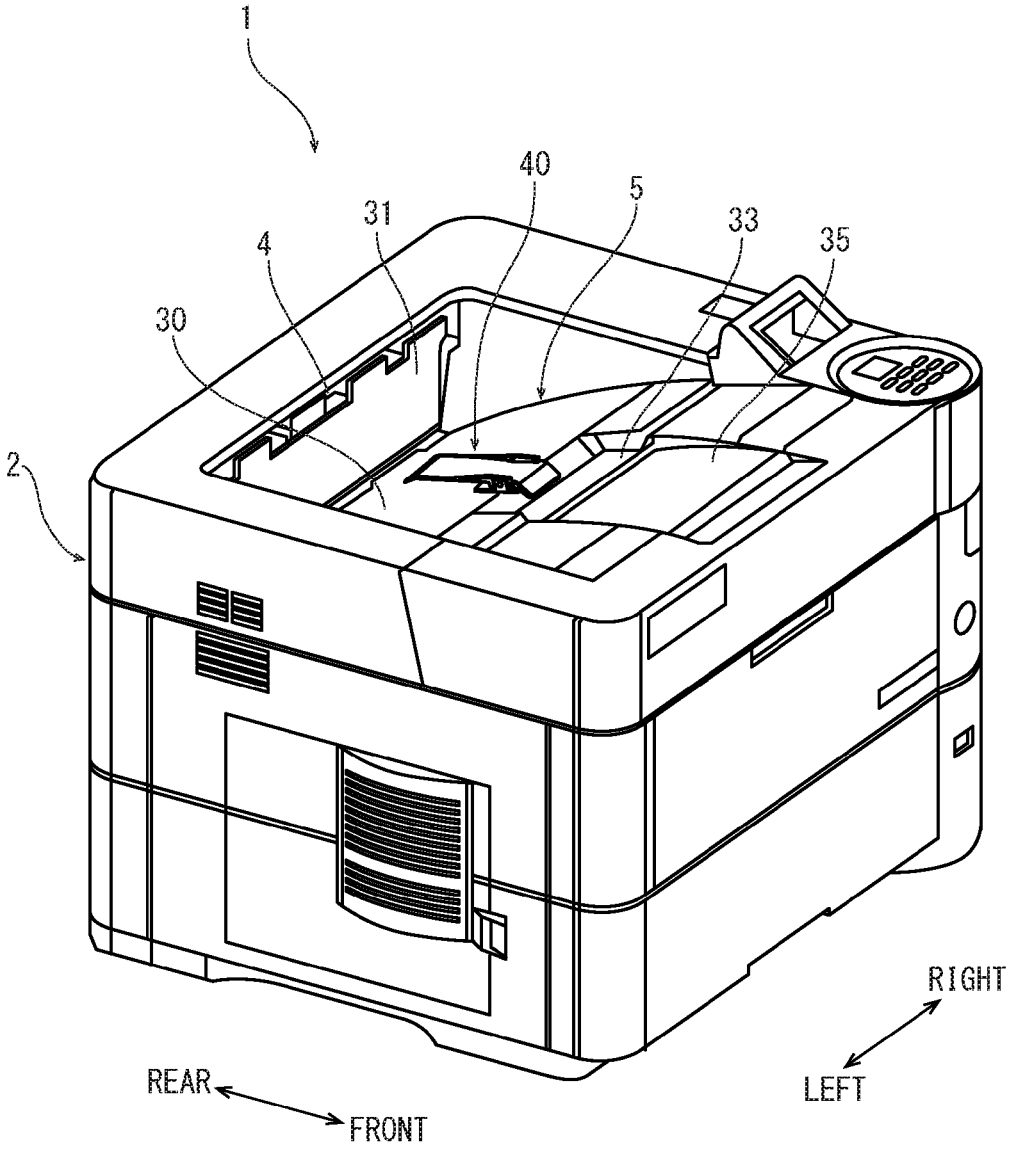
FIG. 1 is a perspective view showing a printer according to an embodiment of the present disclosure.
Figure 2:
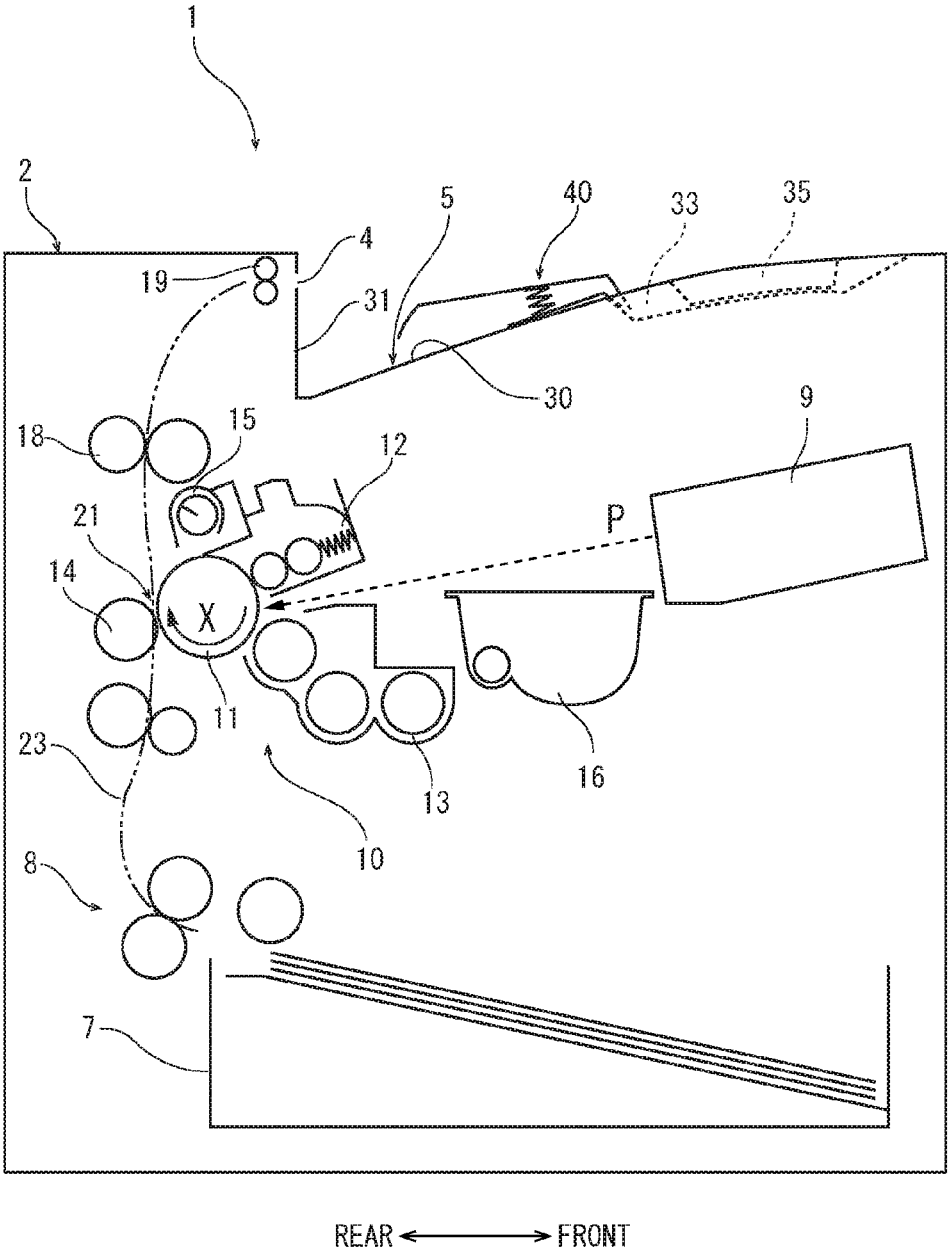
FIG. 2 is a sectional view schematically showing an internal structure of the printer according to the embodiment of the present disclosure.

First, with reference to FIG. 1 and FIG. 2, an entire configuration of a printer 1 as an image forming apparatus will be described. FIG. 1 is a perspective view of the printer and FIG. 2 is a schematic view schematically showing the printer. Forward and backward directions and left and right directions in the following description respectively indicate forward and backward directions and left and right directions shown on a paper sheet of FIG. 1.

The printer 1 includes an apparatus main body 2 formed in a box shape. At a center on a top face of the apparatus main body 2, an ejecting port 4 from which a sheet having a formed image is ejected and an ejected sheet tray 5 onto which the sheet ejected from the ejecting port 4 is stacked are formed. In addition, at a lower part of the apparatus main body 2, a sheet feeding cartridge 7 in which a sheet is stored and a sheet feeding part 8 feeding the sheet from the sheet feeding cartridge 7 are provided. Further, above the sheet feeding cartridge 7, an exposure device 9 composed of a laser scanning unit (LSU) and an image forming part 10 are provided. In the image forming part 10, a photosensitive drum 11 is rotatably provided. Around the photosensitive drum 11, a charging device 12, a development device 13, a transferring roller 14 and a cleaning device 15 are disposed along a rotation direction of the photosensitive drum 11 (refer to the arrow X on FIG. 1). The development device 13 is connected to a toner container 16. Above the image forming part 10, a fixing device 18 is provided and, above the fixing device 18, an ejecting part 19 is provided so as to face to the ejecting port 4.

Inside the apparatus main body 2, a conveying path 23 is arranged so as to run from the sheet feeding part 8, to pass through a transferring nip 21 formed between the photosensitive drum 11 and the transferring roller 14 and through the fixing device 18, and to go toward the ejecting part 19.

Next, an image forming operation of the printer 1 including such a configuration will be described. After a surface of the photosensitive drum 11 has been charged by the charging device 12, exposure corresponding to image data is carried out with respect to the photosensitive drum 11 by laser light (refer to the arrow P) from the exposure device 9, and then, a static latent image is formed on the surface of the photosensitive drum 11. The static latent image is developed on a toner image by the development device 13. The toner remained on the photosensitive drum 11 is removed by the cleaning device 15.

On the other hand, the sheet fed from the sheet feeding cartridge 7 to the conveying path 23 by the sheet feeding part 8 is conveyed to the transferring nip 21 at a timing adjusted with an image forming operation as described above. In the transferring nip 21, the toner image on the photosensitive drum 11 is transferred to a sheet. The sheet having the transferred toner image is conveyed to the fixing device 18 along the conveying path 23 and, in the fixing device 18, the toner image is fixed to the sheet. The sheet having the fixed toner image is conveyed to the ejecting part 19 along the conveying path 23, and then, ejected to the ejected sheet tray 5 through the ejecting port 4.

Next, the ejected sheet tray 5 will be described. As shown in FIG. 1, the ejected sheet tray 5 includes a sheet stacking face 30 inclined upwardly from a lower side of the ejecting port 4 along a sheet ejecting direction and a perpendicular rear wall 31 formed between an end at an upstream side in the ejecting direction of the sheet stacking face 30 and the ejecting port 4. Since the sheet stacking face 30 is thus inclined, the sheet ejected from the ejecting port 4 is naturally dropped along the sheet stacking face 30 until a rear end edge comes into contact with the rear wall 31. An inclination angle of the sheet stacking face 30 is set by approximately 30 degrees and, by increasing this inclination angle, the height of an end wall 31 becomes large and the sheet stack amount can be increased.

Figure 6:
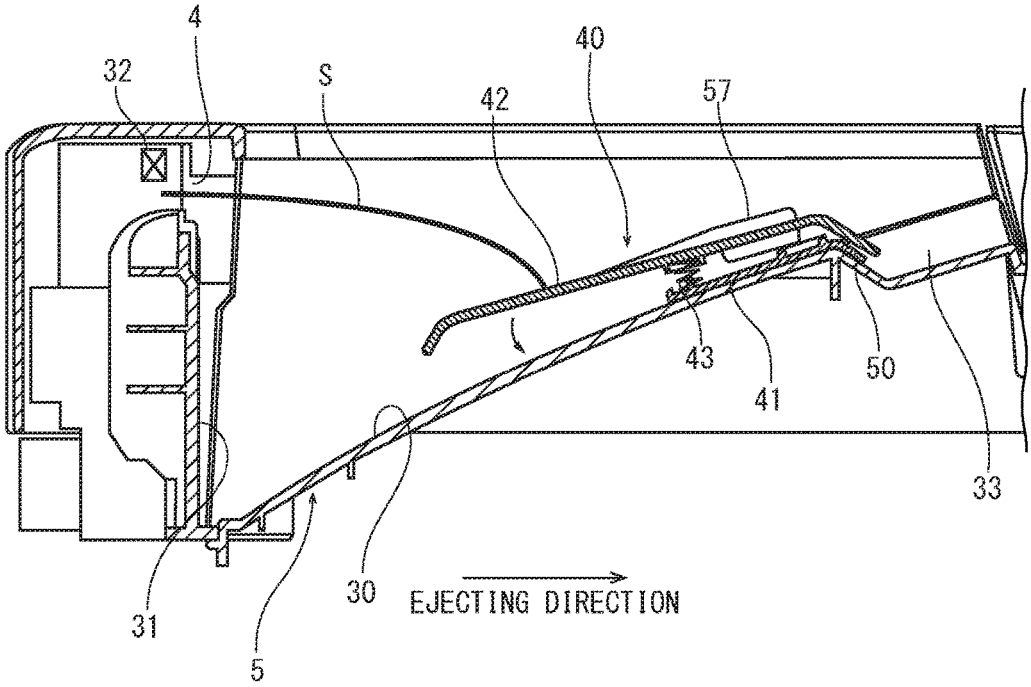
FIG. 6 is a sectional side view showing a guiding member in which a movable guide has been supported at a guiding position in the printer according to the embodiment of the present disclosure.

In the vicinity of the ejecting port 4, a sensor 32 detecting a height of sheets is attached (refer to FIG. 6). The sensor 32 may detect the height of the top sheet of the sheets stacked on the sheet stacking face 30 by the height from the end at the upstream side in the ejecting direction of the sheet stacking face 30 to decide whether or not the sheets stacked on the sheet stacking face 30 is reached the maximum number of stackable sheets.

In addition, at a downstream side in the ejecting direction of the sheet stacking face 30, a rectangular shallow depressed part 33 is formed at a center part in a width direction of the sheet orthogonal to the ejecting direction. In a portion at the downstream side in the ejecting direction of the depressed part 33, an extension tray 35 is turnably supported. In a case where a length of the ejected sheet is large (for example, in the case of a sheet of size A3), if the extension tray 35 is turned, the extension tray 35 is protruded to the downstream side in the ejecting direction more than the ejected sheet tray 5 to support a tip end of the sheet. Further, on the sheet stacking face 30, a guiding member 40 is supported at the upstream side in the ejecting direction more than the depressed part 33.

Figure 3:
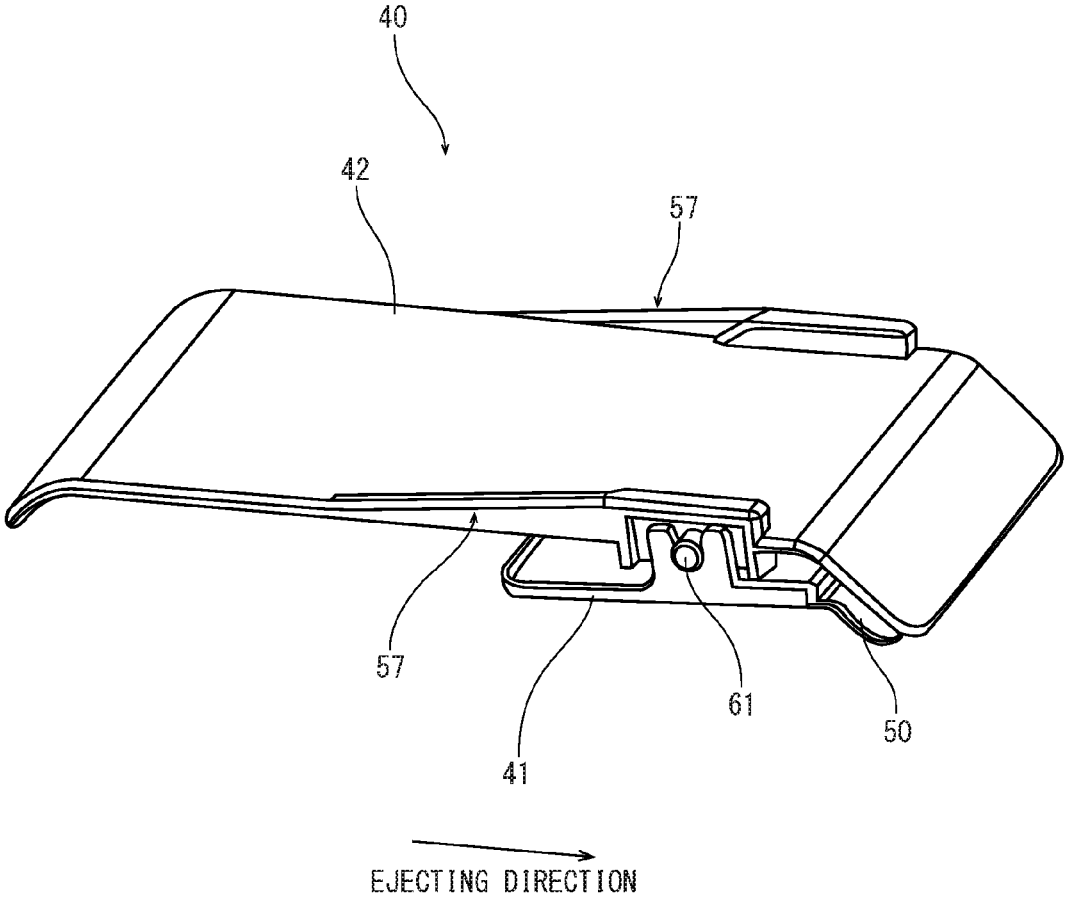
FIG. 3 is a perspective view showing a guiding member in the printer according to the embodiment of the present disclosure.
Figure 4:
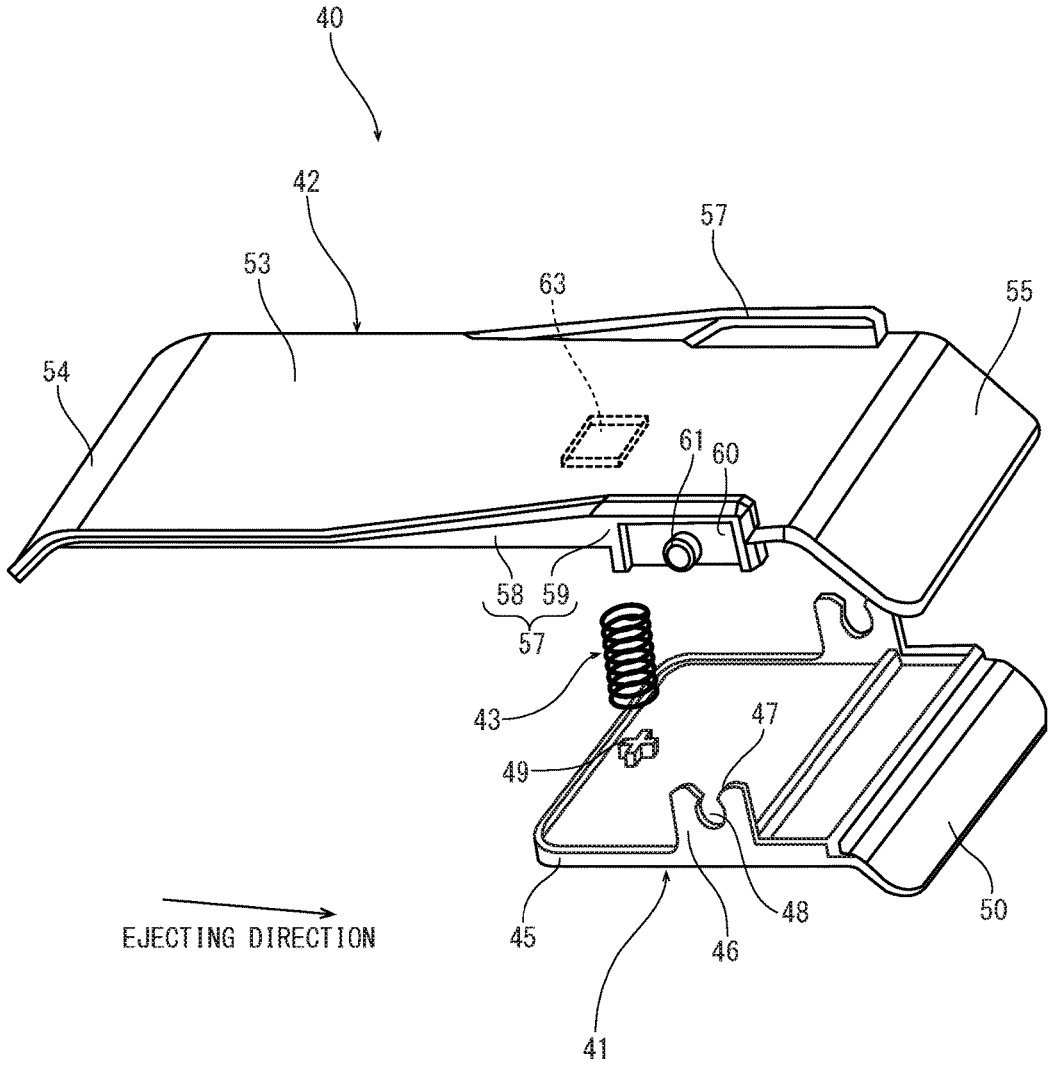
FIG. 4 is an exploded perspective view showing the guiding member in the printer according to the embodiment of the present disclosure.
Figure 5:
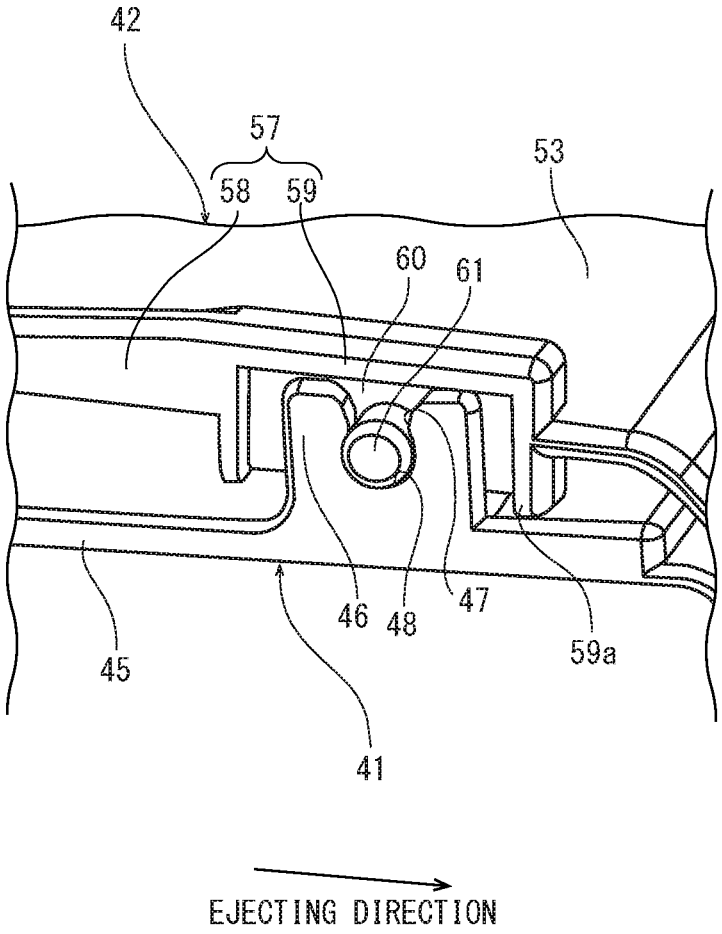
FIG. 5 is an enlarged perspective view showing a supporting shaft of the guiding member and its periphery in the printer according to the embodiment of the present disclosure.

Next, with reference to FIG. 3 to FIG. 5, the guiding member 40 will be described. FIG. 3 is a perspective view of the guiding member, FIG. 4 is an exploded perspective view of the guiding member and FIG. 5 is an enlarged perspective view showing a supporting shaft of a movable guide and its periphery.

The guiding member 40 includes a base member 41 detachably attached to the sheet stacking face 30, a movable guide 42 turnably supported on the base member 41 and a coil spring 43 as a biasing member interposed between the movable guide 42 and the base member 41.

The base member 41 is a rectangular planer member provided along the sheet stacking face 30 and an outer circumferential edge 45 is erected along an outer circumference of the base member 41. Further, at both side edges of the base member 41, bearings 46 with heights larger than the outer circumferential edge 45 are respectively protruded in the vicinity of a center in the ejecting direction. The bearings 46 are formed at an interval smaller than at least a width of the ejected sheet. In each of the bearings 46, a notch 47 cut out downwardly from an upper edge and a shaft hole 40 are vertically continuously formed. The notch 47 is formed so that a width thereof is smaller towards a lower side. In addition, on a top face of the base member 41, a cross-shaped boss 49 is erected at the upstream side in the ejecting direction more than each bearing 46. Further, in an end edge at the downstream side in the ejecting direction of the base member 41, a first inclined piece 50 inclined downwardly is formed.

On a back face of the base member 41, a non-slip sheet, such as a thin rubber sheet, is adhered.

The movable guide 42 has a main body 53 which is a rectangular planar member elongated in the sheet ejecting direction. A length of the main body 53 is set on the order of half of the length along the ejecting direction of the sheet stacking face 30 and a width thereof is set on the order of the same length as a distance between the bearings 46 of the base member 41. In the main body 53, in an end edge at the upstream side in the ejecting direction, a guiding piece 54 curved downwardly is formed and, in an end edge at the downstream side in the ejecting direction, a second inclined piece 55 inclined downwardly is formed.

In the main body 53, guiding walls 57 are formed along both side edges. Each of the guiding walls 57 has an inclined part 58 erected from a portion at the downstream side in the ejecting direction of both side edges and a parallel part 59 formed in a portion at the downstream side in the ejecting direction of the inclined part 58. The inclined part 58 is formed so that an upper end edge thereof is inclined downwardly from the vicinity of the center to the downstream side in the ejecting direction. The parallel part 59 is formed so that an upper end edge and a lower end edge thereof are parallel to the main body 53 and the lower end edge is protruded more downward than the main body 53. In the parallel part 59, a housing part 60 depressed to a side of the main body 53 (a housing depression) is formed. A lower face of the housing part 60 is cut out.

Inside each housing part 60, from a position corresponding to the side edge of the main body 53, a supporting shaft 61 is protruded towards the outside in the width direction of the sheet. A length of the supporting shaft 61 is set on the order of the same length as a depth of the housing part 60 and a tip end of the supporting shaft 61 is not protruded more outside than the hosing part 60. That is, the tip end is not protruded more outside than the guiding wall 57. In this manner, the ejected sheet can be smoothly guided.

Further, on a back face of the main body 53, a rectangular cylindrical spring holding part 63 is formed at the upstream side more than the supporting shaft 61 in the ejecting direction.

The movable guide 42 is turnably supported on the base member 41 around the supporting shaft 61 by pivotally supporting each supporting shaft 61 by a shaft hole 48 of each bearing 46 of the base member 41. When the supporting shaft 61 is pivotally supported by the shaft hole 48, by putting the supporting shaft 61 through the notch 47 of the bearing 46 and pushing downwardly the supporting shaft 61, both side faces of the notch 47 are elastically deformed, and then, the supporting shaft 61 is unremovably supported in the shaft hole 48. Incidentally, by applying a predetermined force to the movable guide 42, the supporting shaft 61 can be removed from the shaft hole 48 through the notch 47.

In addition, by thus pivotally supporting the supporting shaft 61 by the shaft hole 48 of the bearing 46, the bearing 47 is inserted into the housing part 60 from a lower side and, similarly to the supporting shaft 61, the bearing 47 is not be protruded more outside than the housing part 60. In this manner, the ejected sheet can be smoothly guided.

If such a pivoted movable guide 42 is turned in an upward direction (a clockwise direction on FIG. 3 to FIG. 5) around the supporting shaft 61, as shown in FIG. 5, a lower end face 59*a* (a contact part) of the parallel part 59 of the movable guide 42 comes into contact with the outer circumferential edge 45 of the base member 41, and then, turning of the movable guide 42 is restrained. In this manner, the movable guide 42 can be inclined at an appropriate angle.

An upper end of the coil spring 43 is supported by a spring holding part 63 formed on the back face of the main body 53 of the movable guide 42 and a lower end of the coil spring 43 is supported by the boss 49 of the base member 41, and moreover, the coil spring 43 biases the movable guide 42 upwardly with respect to the base member 41. However, as described previously, because upward turning of the movable guide 42 is restrained by the parallel part 59, the movable guide 42 is maintained at a guiding position inclined upwardly towards the upstream side in the ejecting direction at an always predetermined angle (for example, 10 degrees) with respect to the base member 41.

Figure 7:
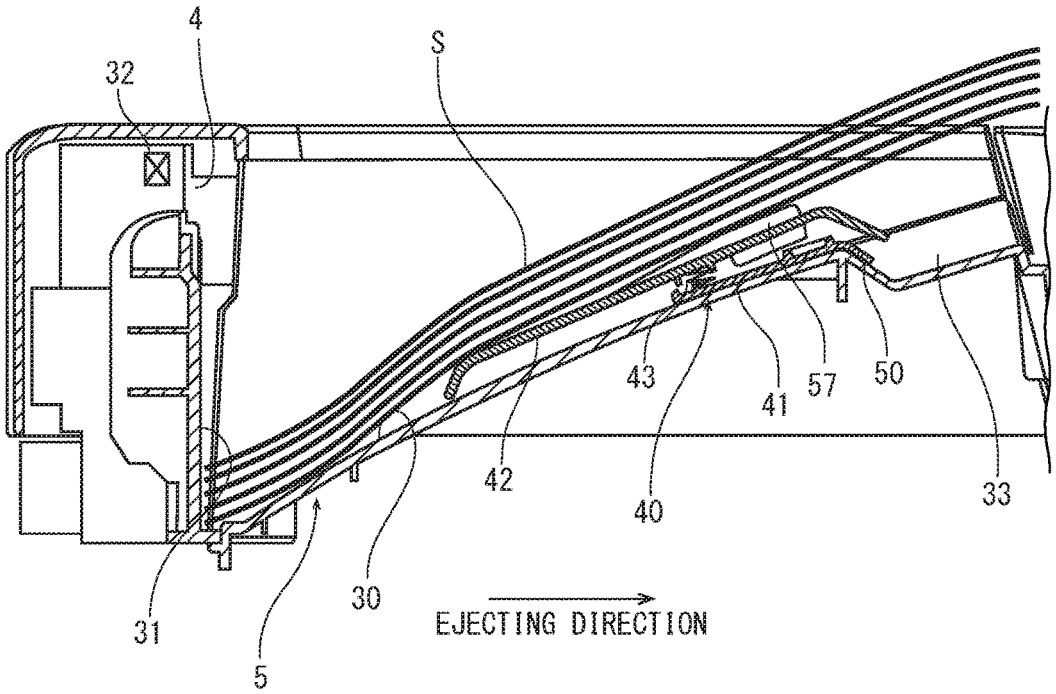
FIG. 7 is a sectional side view showing a guiding member in which sheets are stacked on the movable guide in the printer according to the embodiment of the present disclosure.

A method of guiding the sheet by employing the guiding member 40 having the above-described configuration will be described with reference FIG. 6 and FIG. 7. FIG. 6 is a sectional side view showing the guiding member at the guiding position and FIG. 7 is a sectional side view showing the guiding member on which sheets have been stacked.

In order to attach the guiding member 40 to the sheet stacking face 30 of the ejected sheet tray 5, as shown in FIG. 6, the first inclined piece 50 of the base member 41 is hooked on (locked with) a center part in the width direction of the sheet on a side face at the upstream side in the ejecting direction of the depressed part 33 of the sheet stacking face 30. In this manner, the guiding member 40 is temporarily fixed to the center part in the width direction of the sheet stacking face 30. Further, since a non-slip sheet is adhered onto the back face of the base member 41, the guide member 40 does not drop along the sheet stacking face 30 or is not displaced therefrom.

If the base member 41 is thus supported on the sheet stacking face 30, the movable guide 42 is separated to the downstream side in the ejecting direction more than the end wall 31 and, at a position of the movable guide 42 with where a tip end of the sheet S ejected from the ejecting port 4 can come into contact, the movable guide 42 is biased by the coil spring 43 and is maintained at a guiding position. However, the movable guide 42 is inclined downwardly towards the upstream side in the ejecting direction with respect to a horizontal plane. In addition, the second inclined piece 55 of the movable guide 42 is inserted into the depressed part 33 from an upper side of the first inclined piece 50 of the base member 41 and comes into contact with the first inclined piece 50 from an upper side to restrain upward turning of the movable guide 42.

In the ejected sheet tray 5 to which the guiding member 40 is thus attached, if the sheet S having the downwardly curled tip end is ejected from the ejecting port 4, the tip end of the sheet S comes into contact with the movable guide 42 and is guided along the movable guide 42. In more detail, the tip end of the sheet S is guided along top faces of both guiding walls 57 after the tip end thereof comes into contact with the main body 53 of the movable guide 42. By thus guiding the sheet S along the guide walls 57, a conveyance load of the sheet S can be reduced and the sheet can be smoothly guided. At this time, since there is no portion protruding in an outer direction more than side faces of the guiding walls 57, the tip end of the sheet S is not hooked on the guiding member 40.

Although a part of the ejected sheet S is placed on the movable guide 42, since the movable guide 42 is inclined downwardly towards the upstream side in the ejecting direction with respect to the horizontal plane, the sheet S is slipped down by its own weight along the movable guide 42 and the sheet stacking face 30 and a rear end edge of the sheet S comes into contact with the end wall 31. In addition, a portion at a tip end side in a center part in the width direction of the sheet S is placed on the movable guide 42 and a portion at a rear end side of the sheet S is directly placed on the sheet stacking face 30. In a case where the sheets S are continuously ejected, the tip ends of the ejected sheets S are ejected along a top face of the previously ejected sheet S. In addition, the ejected sheets S is slipped down along the top face of the previously ejected sheet S until the rear end edge of the ejected sheets S comes into contact with the end wall 31, and then, the ejected sheets S is stacked on an upper side of the previously ejected sheet S.

As the ejected sheets S are stacked on the movable guide 42, as indicated by the arrow of FIG. 6, in accordance to the weight of the sheets S, the movable guide 42 is turned gradually downwardly against a biasing force of the coil spring 43. Namely, the height of the movable guide 42 is gradually lowered. However, if the stacked number of the sheets S is increased, since a landing height is heightened by the thickness of the stacked sheets S, the landing height of the tip ends of the sheets S can be maintained at a position higher than that of the sheet stacking face 30.

If the number of stacked sheets S is increased to become a predetermined number or more, the movable guide 42 is turned until the guide piece 54 at the upstream side in the ejecting direction comes into contact with the sheet stacking face 30 and, as shown in FIG. 7, the main body 53 becomes substantially parallel to the sheet stacking face 30. After ejecting of the sheets S has completed, if the ejected sheets S are taken out from the ejected sheet tray 5, the movable guide 42 is biased by the coil spring 43 to revert to the guiding position.

Incidentally, the guiding member 40 may always be attached to the ejected sheet tray 5 or may be attached to the ejected sheet tray 5 only at the time of ejecting of the sheet of which tip end is prone to curl downwardly.

As described above, in the printer 1 of the present disclosure, if the guiding member 40 is attached and the movable guide is supported at the guiding position, since the tip end of the ejected sheet S can be landed on the movable guide 42 at a higher position than that of the sheet stacking face 30, the sheet can be ejected without inversion or displacement of the sheet of which tip end has curled downwardly.

Also, since the guiding member 40 is separated to the downstream side in the ejecting direction more than the end wall 31 and is supported so as to incline downwardly towards the upstream side in the conveyance direction with respect to the horizontal plane, the ejected sheet is slid towards the end wall 31 along the guiding member 40 and the rear ends of the sheets S come into contact with the end wall 31 and are trued up. Therefore, even if the guiding member 40 is attached, the height of the sheets that can be stacked on the sheet stacking face 30 does not vary irrespective of a situation whether or not the guiding member 40 exists, and accordingly, there is no apprehension that the maximum number of stackable sheets is decreased.

In addition, the guiding member 40 is supported at the center part in the width direction of the ejected sheet tray 5 and a pair of guiding walls 57 is formed at an interval smaller than a width of the ejected sheet S. Therefore, it is possible to prevent both side edges of the ejected sheet S from coming into contact with the pair of guiding walls 57 and from being hooked on the guiding walls 57 and the sheet S can be stably guided.

In addition, when the sheet S is taken out from the sheet stacking face 30, in a case where the movable guide 42 is mistakenly gripped together with the sheet S, since the movable guide 42 can be easily detached from the base member 41, there is no apprehension that the guiding member 40 is damaged or a large load is applied to a user. In a case where the movable guide 42 is mistakenly detached, the movable guide 42 can be attached to the base member 41 again with simple procedures for interposing the coil spring 43 between the movable guide 42 and the base member 41 and inserting each supporting shaft 61 into the shaft hole 48 through the notch 47.

Further, since the guiding member 40 is attachable to or detachable from the sheet stacking face 30, the guiding member 40 can be selectively attached thereto or detached therefrom in accordance with a sheet ejection state, such as whether or not a sheet is prone to curl. Furthermore, if the guiding member 40 is prepared as an optional device, the guiding member 40 can be attached to or detached from the ejected sheet tray 5 irrespective of type of printer 1 and wide universality is achieved. Incidentally, although, in the embodiment, the guiding member 40 was supported by hooking it on the depressed part 33 formed in the ejected sheet tray 5, in a case of the ejected sheet tray 5 in which no depressed part 33 is provided or the similar case, the base member 41 may be supported on the sheet stacking face 30 with double-sided tape or the base member 41 may be fastened to the sheet stacking face 30 by screws. Still furthermore, the first inclined piece 50 may be hooked on the ejected sheet tray 5 by adhering a non-slip sheet or a rubber member to the back face of the base member 41. In such a case, the guiding member 40 can be simply attached or detached as an auxiliary component.

Moreover, since the supporting shaft 61 of the movable guide 42 is formed at the position corresponding to the side edge of the main body 53, a thickness of the guiding member 40 can be thinned. If the thickness of the guiding member 40 is thus thinned, as shown in FIG. 7, when the movable guide 42 is turned until the guiding piece 54 comes into contact with the sheet stacking face 30, the top face of the movable guide 42 and the sheet stacking face 30 become substantially parallel to each other and a difference in height between the top face of the movable guide 42 and the sheet stacking face 30 becomes small. Therefore, it is possible to restrain deformation or displacement of the sheets stacked on the movable guide 42.

Further, the embodiment was described in a case of applying the configuration of the present disclosure to the printer 1. On the other hand, in another embodiment, the configuration of the disclosure may be applied to another image forming apparatus, such as a copying machine, a facsimile or a multifunction peripheral, except for the printer 1.

Further, the above-description of the embodiments was described about one example of the image forming apparatus including this according to the present disclosure. However, the technical scope of the present disclosure is not limited to the embodiments. Components in the embodiment described above can be appropriately exchanged with existing components, and various variations including combinations with other existing components are possible. The description of the embodiment described above does not limit the content of the disclosure described in the claims.

What is claimed is:

1. An image forming apparatus comprising:

an ejecting port from which a sheet is ejected;

an ejected sheet tray having a sheet stacking face inclined upwardly towards a downstream side in an ejecting direction of the sheet from a lower side of the ejecting port; and a guiding member provided at a position on the sheet stacking face, the guiding member coming into contact with a tip end of the ejected sheet at the position, wherein the guiding member includes:

a base member detachably attached to the sheet stacking face;

a movable guide, on which the ejected sheet is stacked, turnably supported on the base member around a supporting shaft extending in a width direction of the sheet orthogonal to the ejecting direction; and a biasing member interposed between the base member and the movable guide at an upstream side in the ejecting direction more than the supporting shaft to bias the movable guide upwardly, the movable guide is maintained at a guiding position inclined upwardly towards the upstream side in the ejecting direction at a predetermined angle with respect to the base member by the biasing member and is turned downwardly against a biasing force of the biasing member by weight of stacked sheets, wherein the movable guide includes:

a main body with which a tip end of the ejected sheet comes into contact;

a pair of guiding walls formed along both side edges in the width direction of the main body and configured to have an inclined part of which an upper end edge is inclined upwardly towards the downstream side in the ejecting direction and a parallel part provided at the downstream side in the ejecting direction of the inclined part so that an upper end edge thereof is parallel to the main body; and a housing depression formed on a side face of the parallel part, the supporting shaft is formed in the respective housing depression so as to protrude towards an outside in the width direction and so as not to protrude from the housing depression.

2. The image forming apparatus according to claim 1, wherein the base member has a pair of bearings protruded at both side edges thereof and configured to pivotally support the supporting shafts, the pair of bearings are housed in the housing depression in a state pivotally supporting the supporting shafts.

3. The image forming apparatus according to claim 1, wherein a lower end edge of the parallel part is protruded more downward than the main body, the lower end edge of the parallel part has a contact part provided at the downstream side in the ejecting direction more than the supporting shaft and configured to come into contact with the base member to restrain turning of the movable guide, when the movable guide is turned in an upward direction around the supporting shaft.

4. The image forming apparatus according to claim 1, wherein the pair of guiding walls are formed at an interval smaller than a width of the ejected sheet.

5. The image forming apparatus according to claim 1, wherein the guiding member is supported at a center part in the width direction of the ejected sheet tray and an interval between the pair of guiding walls is set smaller than a width of the ejected sheet.

6. A image forming apparatus comprising:

an ejecting port from which a sheet is ejected;

an ejected sheet tray having a sheet stacking face inclined upwardly towards a downstream side in an ejecting direction of the sheet from a lower side of the ejecting port; and a guiding member provided at a position on the sheet stacking face, the guiding member coming into contact with a tip end of the ejected sheet at the position, wherein the guiding member includes:

a base member detachably attached to the sheet stacking face;

a movable guide, on which the ejected sheet is stacked, turnably supported on the base member around a supporting shaft extending in a width direction of the sheet orthogonal to the ejecting direction; and a biasing member interposed between the base member and the movable guide at an upstream side in the ejecting direction more than the supporting shaft to bias the movable guide upwardly, the movable guide is turned downwardly against a biasing force of the biasing member by weight of stacked sheets, the sheet stacking face has a depressed part formed at the downstream side in the ejecting direction, the guiding member has a first inclined piece inclined downwardly from an end edge at the downstream side in the ejecting direction of the base member, the guiding member is attached to the sheet stacking face by locking the first inclined piece with a side face at the upstream side in the ejecting direction of the depressed part.

7. The image forming apparatus according to claim 6, wherein the movable guide has a main body as a planar member and a second inclined part inclined downwardly from an end edge at the downstream side in the ejecting direction of the main body, the second inclined piece of the movable guide comes into contact with the first inclined piece of the base member from an upper side to restrain upward turning of the movable guide.

8. The image forming apparatus according to claim 7, wherein the movable guide further has a guiding piece curved downwardly from an end edge at the upstream side in the ejecting direction of the main body, the movable guide is turned until the guiding piece comes into contact with the sheet stacking face, if the number of stacked sheets becomes a predetermined number or more, so that the main body becomes parallel to the sheet stacking face.

* * * * *